US010874159B1

(12) United States Patent
Kinzer et al.

(10) Patent No.: US 10,874,159 B1
(45) Date of Patent: Dec. 29, 2020

(54) PROTECTIVE HELMET WITH ATTACHMENT MECHANISM FOR SECURING ACCESSORIES

(71) Applicant: E.D. Bullard Company, Cynthiana, KY (US)

(72) Inventors: Paul A. Kinzer, Georgetown, KY (US); Travis J. Plumlee, Georgetown, KY (US)

(73) Assignee: E.D. Bullard Company, Cynthiana, KY (US)

( * ) Notice: Subject to any disclaimer, the term of this patent is extended or adjusted under 35 U.S.C. 154(b) by 44 days.

(21) Appl. No.: 15/934,633

(22) Filed: Mar. 23, 2018

Related U.S. Application Data

(60) Provisional application No. 62/478,724, filed on Mar. 30, 2017.

(51) Int. Cl.

| | |
|---|---|
| ***A42B 3/06*** | (2006.01) |
| ***A42B 3/22*** | (2006.01) |
| ***A42B 3/04*** | (2006.01) |

(52) U.S. Cl.
CPC ..... *A42B 3/062* (2013.01); *A42B 3/221* (2013.01); *A42B 3/0406* (2013.01); *A42B 3/225* (2013.01)

(58) Field of Classification Search
CPC .. A42B 3/04; A42B 3/14; A42B 3/062; A42B 3/064; A42B 3/205; A42B 3/206;
(Continued)

(56) References Cited

U.S. PATENT DOCUMENTS 3,373,444 A * 3/1968 Militello ..... A42B 3/185 2/10
3,430,262 A * 3/1969 Raschke ..... A42B 3/225 2/8.1

(Continued)

FOREIGN PATENT DOCUMENTS

EP 0465971 A2 * 1/1992
EP 0572760 A1 * 12/1993

OTHER PUBLICATIONS

"Cat Ratchet Suspension Hard Hat Yellow." Amazon, Amazon, Jan. 14, 2016, www.amazon.com/Cat-Ratchet-Suspension-Hard-Yellow/dp/B01AKWRTRY. (Year: 2016).*

(Continued)

*Primary Examiner* — Katherine M Moran
*Assistant Examiner* — Grace Huang
(74) *Attorney, Agent, or Firm* — Stites & Harbison, PLLC; David W. Nagle, Jr.; Gary N. Stewart

(57) ABSTRACT

A protective helmet includes a shell, which defines a bottom opening and an internal cavity for receiving the wearer's head. The shell further includes a brim with a central opening defined in the brim. An attachment mechanism for securing an accessory to the shell includes one or more openings defined through the brim on either side of the central opening, wherein each of the openings includes a larger diameter portion and a smaller diameter portion, which are separated by a detent. Each opening receives a respective boss of the accessory, which can be selectively advanced from the larger diameter portion to the small diameter portion of the opening. Furthermore, the attachment mechanism includes a slot defined in and along the edge of the shell, with the slot corresponding with the central opening defined in the brim, such that the slot is configured to receive a projection extending from the accessory.

20 Claims, 8 Drawing Sheets

(58) Field of Classification Search
CPC ..... A42B 3/221; A42B 3/0406; A42B 3/225; A42B 3/18; A42B 3/22; A43B 3/18; A43B 3/22; Y10T 24/45215; Y10T 24/50
USPC ..... 2/6.2, 6.3, 6.4, 6.7, 15, 175.1, 175.2, 2/175.3, 422
See application file for complete search history.

(56) References Cited

U.S. PATENT DOCUMENTS 5,404,577 A * 4/1995 Zuckerman ..... A42B 3/30 455/351
5,890,233 A * 4/1999 Kaffka ..... A42B 3/226 2/10
6,041,435 A * 3/2000 Paulson ..... A42B 3/225 2/10
6,609,254 B2 8/2003 Bielefeld et al.
7,174,575 B1 2/2007 Scherer
7,707,648 B2 * 5/2010 Watabiki ..... A42B 3/227 2/10
8,015,626 B2 * 9/2011 Grassl ..... A42B 3/04 2/410
8,166,577 B2 * 5/2012 Lee ..... A42B 3/222 2/15
8,336,123 B2 * 12/2012 Gleason ..... A42B 3/225 2/424
8,618,936 B2 12/2013 Niederer, III et al.
2004/0181856 A1 * 9/2004 Oleson ..... A42B 3/04 2/424
2004/0199982 A1 * 10/2004 Wang-Lee ..... A42B 3/225 2/424
2007/0011794 A1 * 1/2007 Wang Lee ..... A42B 3/227 2/10
2007/0067887 A1 * 3/2007 Lee ..... A42B 3/227 2/12
2014/0208487 A1 * 7/2014 Orientale ..... A42B 3/0433 2/422

OTHER PUBLICATIONS

"Cat Ratchet Suspension Hard Hat Yellow." Amazon, Amazon, Jan. 14, 2016, www.amazon.com/Cat-Ratchet-Supension-Hard-Yellow/dp/B01AKWRTRY. (Year: 2016).*
Boss Manufacturing Company, Global Licensee for Gloves and Safety Products for Caterpillar Inc., Vented Yellow Hard Hat ANSI Approved CE Certified. http://www.catgloves.com/products-page/new-products/yellow-hard-hat-ansi-approved-ce-certified-2/ (downloaded Jun. 29, 2018).

* cited by examiner

PROTECTIVE HELMET WITH ATTACHMENT MECHANISM FOR SECURING ACCESSORIES

CROSS-REFERENCE TO RELATED APPLICATIONS

The present application claims priority to U.S. Patent Application Ser. No. 62/478,724 filed on Mar. 30, 2017, the entire disclosure of which is incorporated herein by reference.

BACKGROUND OF THE INVENTION

The present invention relates to a protective helmet.

Protective helmets are commonly worn in the industrial workplace to prevent or reduce the likelihood of head injuries. The hard hat is the most common and well-recognized protective helmet. A hard hat consists of three primary components—a shell, a headband, and a suspension system—which cooperate to reduce the potential for injury by attenuating some translational energy of the force of an impact to the helmet.

A hard hat or similar protective helmet is comprised primarily of: a shell; a headband; and a suspension system. These primary hard hat components cooperate to provide the requisite level of protection. The hard hat shell itself causes any force of impact to be spread across the surface area of the shell. The hard hat suspension separates the wearer's head from the shell such that there is an air gap between the shell and the wearer's head that provides for further attenuation of the force of an impact to the shell. Specifically, when an object strikes the shell of the hard hat, the shell itself flexes inward and the straps of the suspension system will stretch. The air gap accommodates the flexing of the shell and stretching of the straps, but, under normal conditions, prevents the wearer's head from contacting the hard hat shell.

Common hard hat constructions are described, for example, in U.S. Pat. Nos. 6,609,254 and 7,174,575, which are incorporated herein by reference.

It is often desirable to incorporate or attach accessories to the hard hat or other protective helmet, such as clear/tinted visors, face protection shields, hydration devices, electronic communication devices, lighting apparatus, etc. For example, U.S. Pat. No. 8,618,936, which is incorporated herein by reference, describes the incorporation of a visor into a protective helmet, such as a hard hat. Specifically, U.S. Pat. No. 8,618,936 describes a construction in which the hard hat includes a crown configured to fit on a wearer's head. A bill extends from the crown, and at least a portion of the bill is transparent. Furthermore, a filtration material is positioned about the transparent portion of the bill, and this filtration material is reactive to radiant energy, such that radiant energy is selectively permitted to pass through the transparent portion of the bill.

In any event, there remains a need for an attachment mechanism for securing accessories to a hard hat or other protective helmet, preferably a simple mechanism that preferably requires no use of tools.

SUMMARY OF THE INVENTION

The present invention is a protective helmet with an attachment mechanism for securing accessories.

An exemplary protective helmet including an attachment mechanism made in accordance with the present invention has a substantially rigid shell shaped to protect the wearer's head, with the shell defining a bottom opening and an internal cavity for receiving the wearer's head. The shell further includes a brim (or bill). The brim is not continuous around the circumference of the shell. Rather, there is a central opening defined in the brim of the shell at the front, an opening that generally corresponds to the forehead of the wearer. Furthermore, a slot is defined in and along the edge of the shell, with the slot corresponding with the central opening defined in the brim of the shell.

On one side of the central opening, there are one or more openings defined through the brim. Each opening is in the form of a keyhole (or figure-eight) slot that includes a larger diameter (or enlarged) portion and a smaller diameter (or reduced) portion, which are separated by a detent.

On the other side of the central opening, there are also one or more openings defined through the brim. Each opening is also in the form of a keyhole (or figure-eight) slot that includes a larger diameter (or enlarged) portion and a smaller diameter (or reduced) portion, which are separated by a detent.

An accessory is designed to mate with the shell through interaction with the slot defined in and along the edge of the shell and the respective openings defined through the brim on either side of the central opening. Specifically, the accessory includes bosses extending from a surface thereof. Each of these bosses has a shank portion and an enlarged head, and each of these bosses is sized and spaced to correspond with a respective opening defined through the brim on one side of the central opening. The accessory also includes a projection that extends from the accessory and is sized to correspond to and mate with the slot defined in the brim of the shell.

In practice, the accessory is positioned such that all bosses are in the larger diameter (or enlarged) portion of the corresponding openings. In this regard, the enlarged head of each of the bosses passes through the corresponding opening. At the same time, the edge of the projection extending from the accessory is aligned with the slot defined in and along the edge of the shell. Each of the openings includes an "over-center" snap feature. Thus, by applying pressure to advance the accessory toward the shell, each of the bosses passes over a detent (i.e., passes "over-center") and into the smaller diameter (or reduced) portion of the corresponding opening, thus "snapping" the accessory into place. At the same time, the projection mates with and effectively fills the slot defined in and along the edge of the shell, thus creating a substantially watertight seal.

DETAILED DESCRIPTION OF THE INVENTION

The present invention is a protective helmet with an attachment mechanism for securing accessories.

Figure 1:
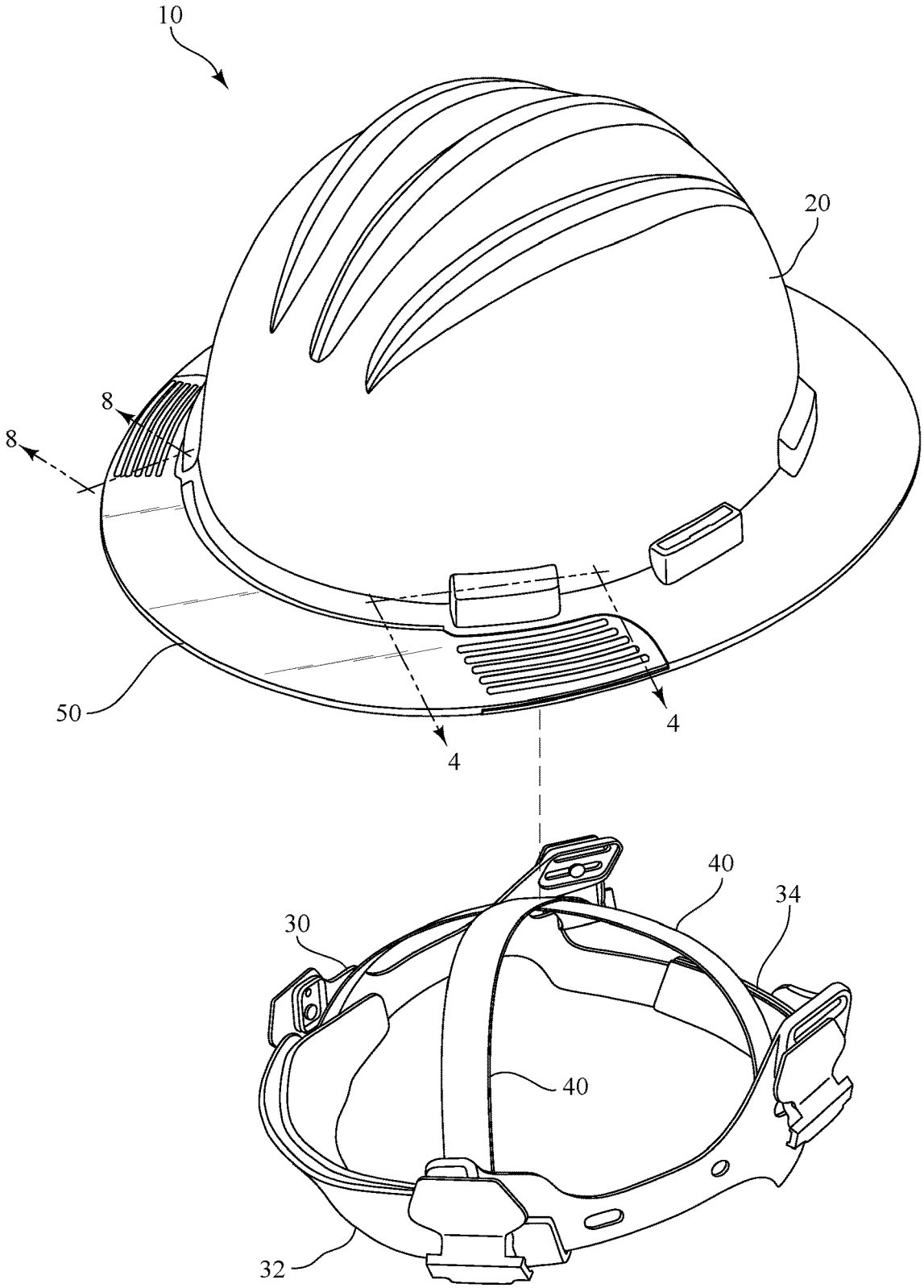
FIG. 1 is a perspective view of an exemplary protective helmet that includes an attachment mechanism made in accordance with the present invention, securing a visor to the helmet.

FIG. 1 is a perspective view of an exemplary protective helmet 10 that includes an attachment mechanism made in accordance with the present invention, securing a visor 50 to the helmet 10. As shown in FIG. 1, in this exemplary embodiment, the protective helmet is a hard hat 10, which generally includes: a substantially rigid shell 20 shaped to protect the wearer's head, with the shell 20 defining a bottom opening and an internal cavity for receiving the wearer's head; a headband 30; and a suspension 40. In FIG. 1, the shell 20 is separated from the other components for purposes of illustration.

Referring still to FIG. 1, in this exemplary embodiment, the hard hat 10 has a 4-point suspension comprised of two intersecting straps. A key is secured to each end of each of the straps. Thus, to secure the suspension 40 to the shell 20 of the hard hat 10, the shell 20 includes four key sockets spaced about the periphery of the shell 20, each such key socket being molded into the shell 20 and adapted to receive one of the keys. The keys are constructed such that they can be "locked" into the key sockets. For further details regarding such use of keys and key sockets to secure the suspension 40 to the shell 20 of the hard hat 10, see, for example, U.S. Pat. Nos. 6,609,254 and 7,174,575, which, as mentioned above, have been incorporated herein by reference.

In this exemplary embodiment, the headband 30 also includes a ratchet mechanism 34 that allows for ready adjustment of the size and fit of the headband 30. For further details regarding the construction of such a ratchet mechanism 34, see, for example, U.S. Pat. No. 7,174,575, which, as mentioned above, has been incorporated herein by reference.

Figure 2:
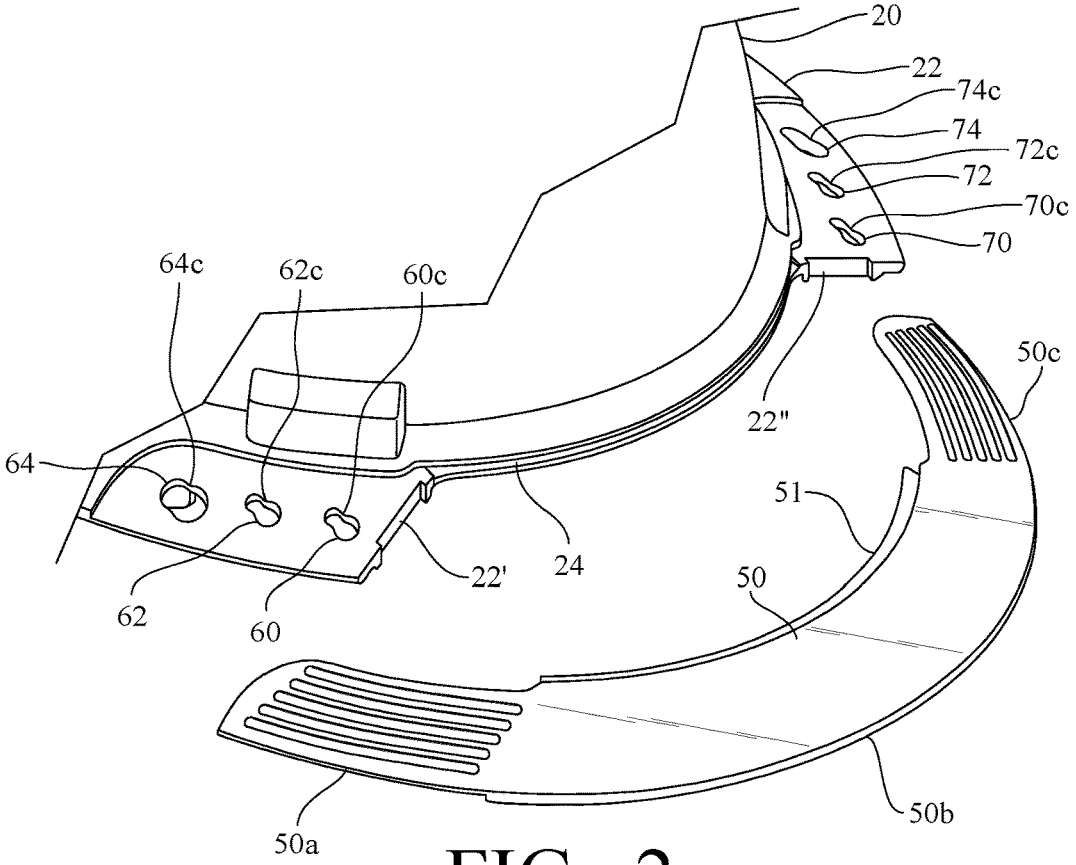
FIG. 2 is a partial top perspective view of the exemplary protective helmet of FIG. 1, with the visor separated from the shell of the helmet.
Figure 3:
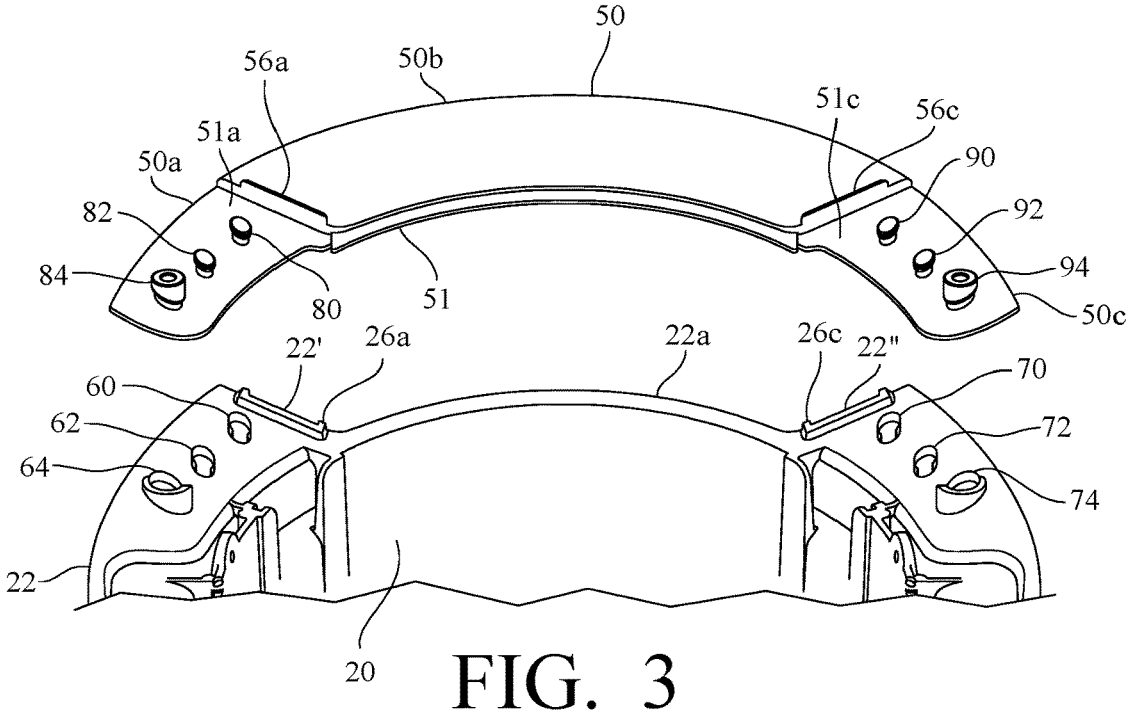
FIG. 3 is a partial bottom perspective view of the exemplary protective helmet of FIG. 1, with the visor separated from the shell of the helmet.

With respect to the attachment mechanism of the present invention, the focus is on the shell 20 of the hard hat 10. Referring now to FIGS. 2 and 3, the shell 20 includes a brim (or bill) 22. Unlike prior art constructions, however, the brim 22 is not continuous around the circumference of the shell 20. Rather, there is a central opening 22*a* defined in the brim 22 of the shell 20 at the front of the hard hat 10, an opening that generally corresponds to the forehead of the wearer, extending between a first portion 22' of the brim 22 and a second portion 22" of the brim 22. This provides an area for receiving an accessory, as further described below.

Referring still to FIGS. 2 and 3, a slot 24 is defined in and along the edge of the shell 20, with the slot 24 corresponding with the central opening 22*a* defined in the brim 22 of the shell 20, thus also extending between the first portion 22' of the brim 22 and the second portion 22" of the brim 22.

Referring still to FIGS. 2 and 3, on a first side of the central opening 22*a*, there are one or more openings defined through the first portion 22' of the brim 22. In this exemplary embodiment, there are three such openings 60, 62, 64, each of which is in the form of a keyhole (or figure-eight) slot that includes a larger diameter (or enlarged) portion and a smaller diameter (or reduced) portion, which are separated by a detent, as will be further described below. Furthermore, in this exemplary embodiment, the rearmost opening 64 is larger than the other two openings 60, 62, the importance of which will also be further described below.

Referring still to FIGS. 2 and 3, on the second (or other) side of the central opening 22*a*, there are also one or more openings defined through the second portion 22" of the brim 22. In this exemplary embodiment, there are also three such openings 70, 72, 74, each of which is in the form of a keyhole (or figure-eight) slot that includes a larger diameter (or enlarged) portion and a smaller diameter (or reduced) portion, which are separated by a detent. Furthermore, the rearmost opening 74 is larger than the other two openings 70, 72. Thus, in this exemplary embodiment, the openings 60, 62, 64 defined through the brim 22 on the first side of the central opening 22*a* are identical to those openings 70, 72, 74 defined through the brim 22 on the second side of the central opening 22*a*.

An accessory is designed to mate with the shell 20 through interaction with the slot 24 defined in and along the edge of the shell 20 and the respective openings 60, 62, 64, 70, 72, 74 defined through the brim 22 on either side of the central opening 22*a*.

In one exemplary embodiment, and referring again to FIGS. 2 and 3, a visor (or lens) 50 is mated to the shell 20 of the hard hat 10. In this regard, the visor 50 is a unitary member in the general form of an arc, but can be generally characterized as including a first end portion 50*a*, an intermediate portion 50*b*, and a second end portion 50*c*.

Referring now to FIG. 3, the first end portion 50*a* of the visor 50 includes three bosses 80, 82, 84 extending from the bottom surface 51*a* thereof. Each of these bosses 80, 82, 84 has a shank portion and an enlarged head (as further described below). Furthermore, these bosses 80, 82, 84 are sized and spaced to correspond with the openings 60, 62, 64 defined through the brim 22 on one side of the central opening 22*a*.

The intermediate portion 50*b* includes an arc-shaped wedge (or projection) 51 that extends from the visor 50 and is sized to correspond to and mate with the slot 24 defined in the brim 22 of the shell 20, as further described below.

The second end portion 50*c* of the visor 50 also includes three bosses 90, 92, 94 extending from the bottom surface 51*c* thereof. Each of these bosses 90, 92, 94 also has a shank portion and an enlarged head (as further described below), and these bosses 90, 92, 94 are substantially identical to the bosses 80, 82, 84 on the first end portion 50*a* of the visor 50. Furthermore, these bosses 90, 92, 94 are sized and spaced to correspond with the openings 70, 72, 74 defined through the brim 22 on the other side of the central opening 22*a*.

Figure 5:
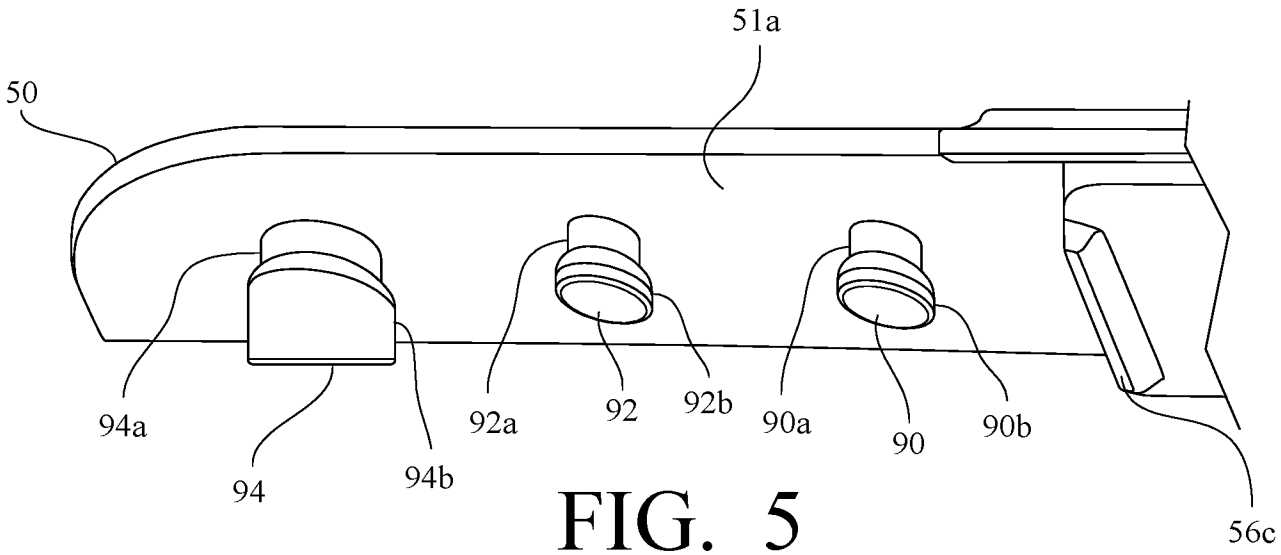
FIG. 5 is an enlarged view similar to FIG. 4, but showing only the visor and the bosses extending from the bottom surface thereof.

FIG. 5 is an enlarged view of the visor 50 and the bosses 90, 92, 94 extending from the bottom surface 51*a* thereof. As shown, and as described above, each of these bosses 90, 92, 94 has a shank portion 90*a*, 92*a*, 94*a* and an enlarged head 90*b*, 92*b*, 94*b*. Furthermore, as also described above, these bosses 90, 92, 94 are substantially identical to the bosses 80, 82, 84 on the first end portion 50*a* of the visor 50.

Figure 6:
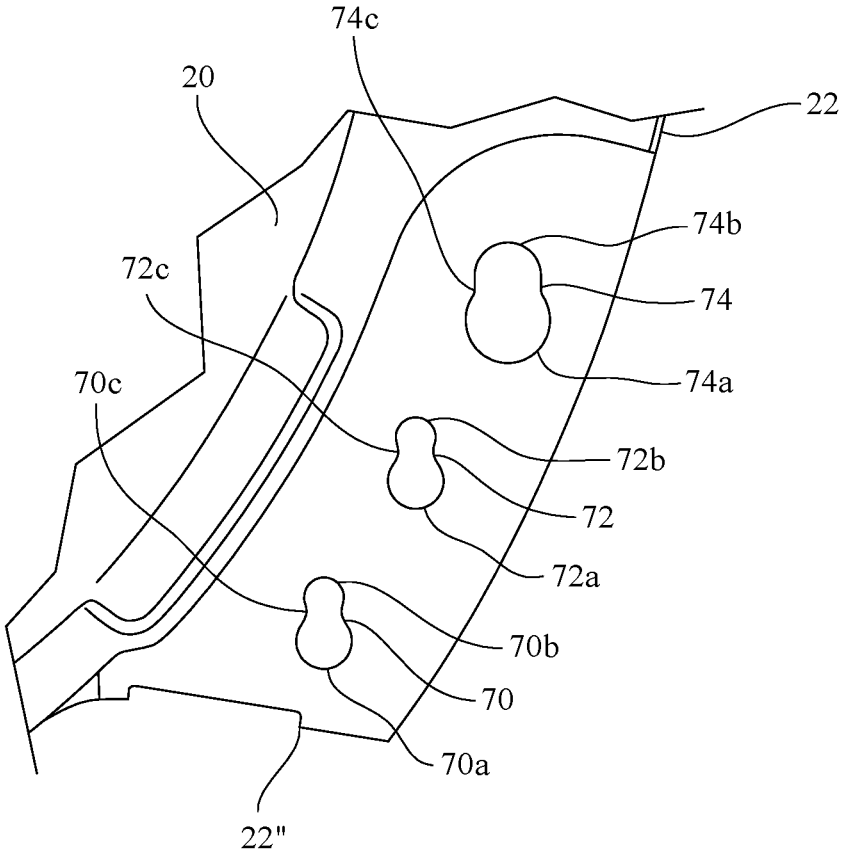
FIG. 6 is an enlarged, partial top view of the shell of the exemplary protective helmet of FIG. 1.

FIG. 6 is an enlarged, partial top view of the shell 20, which further illustrates the openings 70, 72, 74. As shown, and as described above, each opening 70, 72, 74 is in the form of a keyhole (or figure-eight) slot that includes a larger diameter (or enlarged) portion 70*a*, 72*a*, 74*a* and a smaller diameter (or reduced) portion 70*b*, 72*b*, 74*b*, which are separated by a detent 70*c*, 72*c*, 74*c*. Furthermore, as also described above, these openings 70, 72, 74 are substantially identical to the openings 60, 62, 64 defined through the brim 22 of the shell 20 on the other side of the central opening 22*a*.

As mentioned above, the visor 50 is designed to mate with the shell 20 through interaction with the slot 24 defined in and along the edge of the shell 20 and the respective openings 60, 62, 64, 70, 72, 74 defined through the brim 22 of the shell 20 on either side of the central opening 22*a*. In practice, the visor 50 is positioned such that all six bosses 80, 82, 84, 90, 92, 94 are in the larger diameter (or enlarged) portion (as indicated, for example, by reference numbers 70*a*, 72*a*, 74*a* in FIG. 6) of the corresponding openings 60, 62, 64, 70, 72, 74. In this regard, the enlarged head (as indicated, for example, by reference numbers 90*b*, 92*b*, 94*b* in FIG. 5) of each of the six bosses 80, 82, 84, 90, 92, 94 passes through the corresponding opening 60, 62, 64, 70, 72, 74. At the same time, the edge of the wedge 51 extending from the intermediate portion 50*b* of the visor is aligned with the slot 24 defined in and along the edge of the shell 20.

Each of the openings 60, 62, 64, 70, 72, 74 includes an "over-center" snap feature. Thus, by applying pressure to advance the visor 50 toward the shell 20, each of the six bosses 80, 82, 84, 90, 92, 94 passes over a detent 60*c*, 62*c*, 64*c*, 70*c*, 72*c*, 74*c* (i.e., passes "over-center") and into the smaller diameter (or reduced) portion (as indicated, for example, by reference numbers 70*b*, 72*b*, 74*b* in FIG. 6) of the corresponding opening 60, 62, 64, 70, 72, 74, thus "snapping" the visor 50 into place. At the same time, the wedge 51 mates with and effectively fills the slot 24 defined in and along the edge of the shell 20, thus creating a substantially watertight seal.

Figure 4:
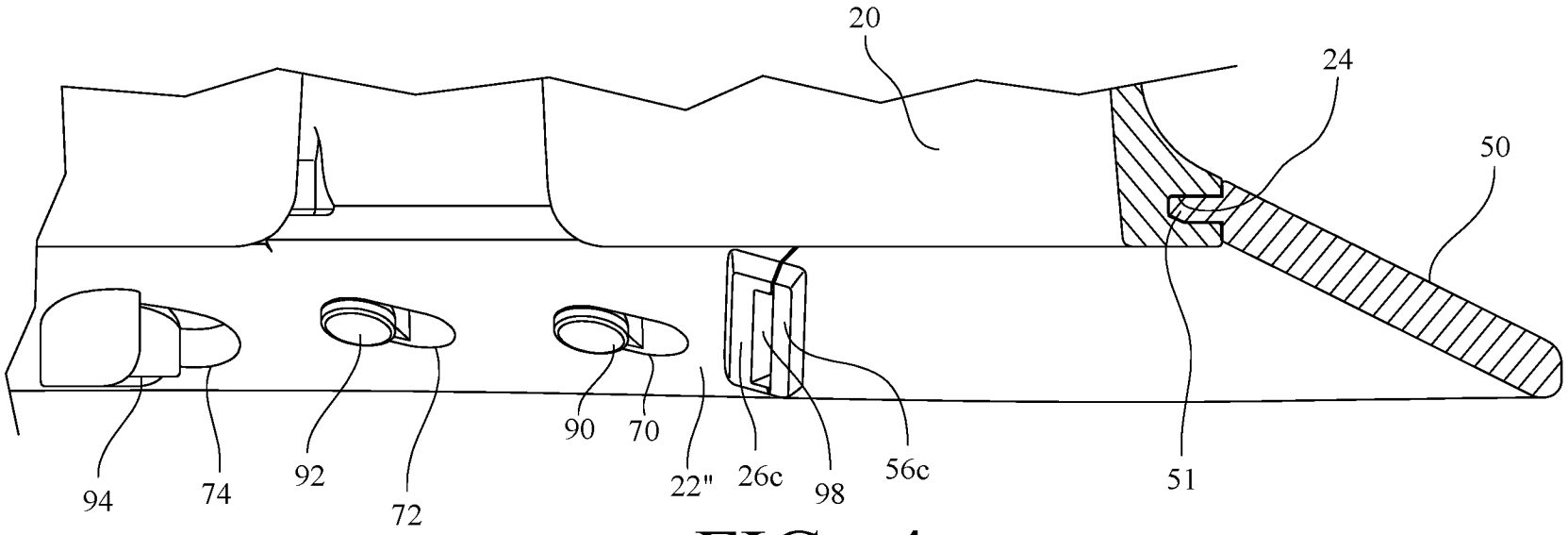
FIG. 4 is a partial sectional view of the exemplary protective helmet of FIG. 1 taken along line 4-4 of FIG. 1, with the visor secured to the shell.

FIG. 4 is a partial sectional view of the exemplary protective helmet 10 taken along line 4-4 of FIG. 1 that illustrates the positioning of the bosses 90, 92, 94 in the corresponding openings 70, 72, 74 of the shell 20 when the visor 50 is secured to the shell 20 of the exemplary protective helmet 10. Of course, the bosses 80, 82, 84 are similarly positioned in the corresponding openings 60, 62, 64 of the shell 20 on the other side of the protective helmet 10 when the visor 50 is secured to the shell 20.

Figure 7:
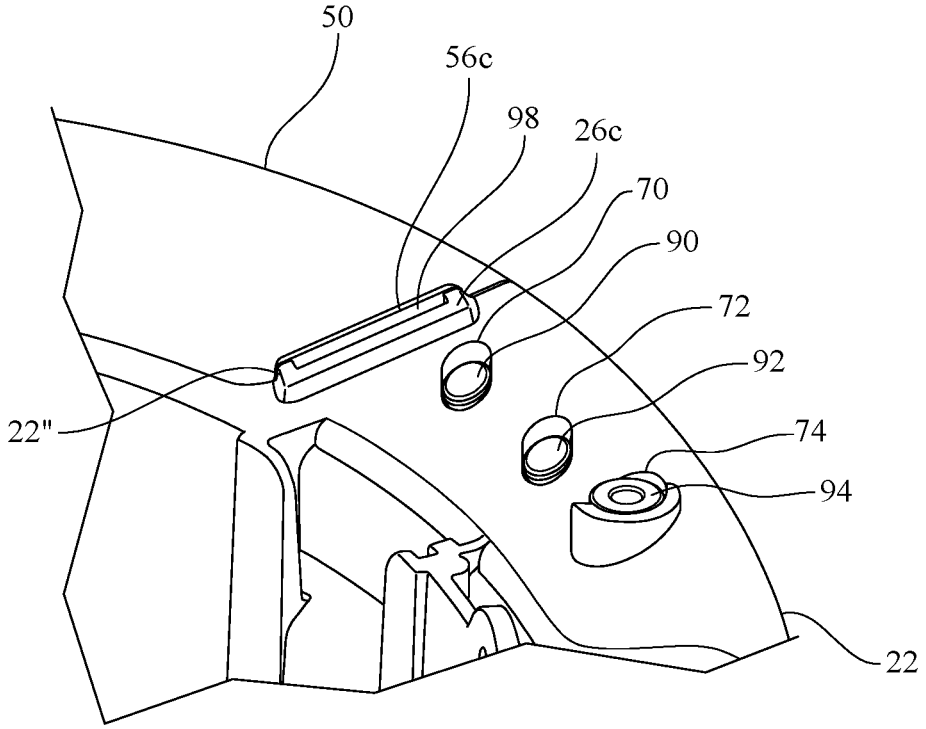
FIG. 7 is a partial bottom perspective view of the exemplary protective helmet of FIG. 1, with the visor secured to the shell.

FIG. 7 is a partial bottom perspective view of the exemplary protective helmet 10, with the visor 50 secured to the shell 20 that further illustrates the positioning of the bosses 90, 92, 94 in the corresponding openings 70, 72, 74 of the shell 20 when the visor 50 is secured to the shell 20 of the exemplary protective helmet 10. Again, the bosses 60, 62, 64 are similarly positioned in the corresponding openings 80, 82, 84 of the shell 20 on the other side of protective helmet 10 when the visor 50 is secured to the shell 20.

Figure 8:
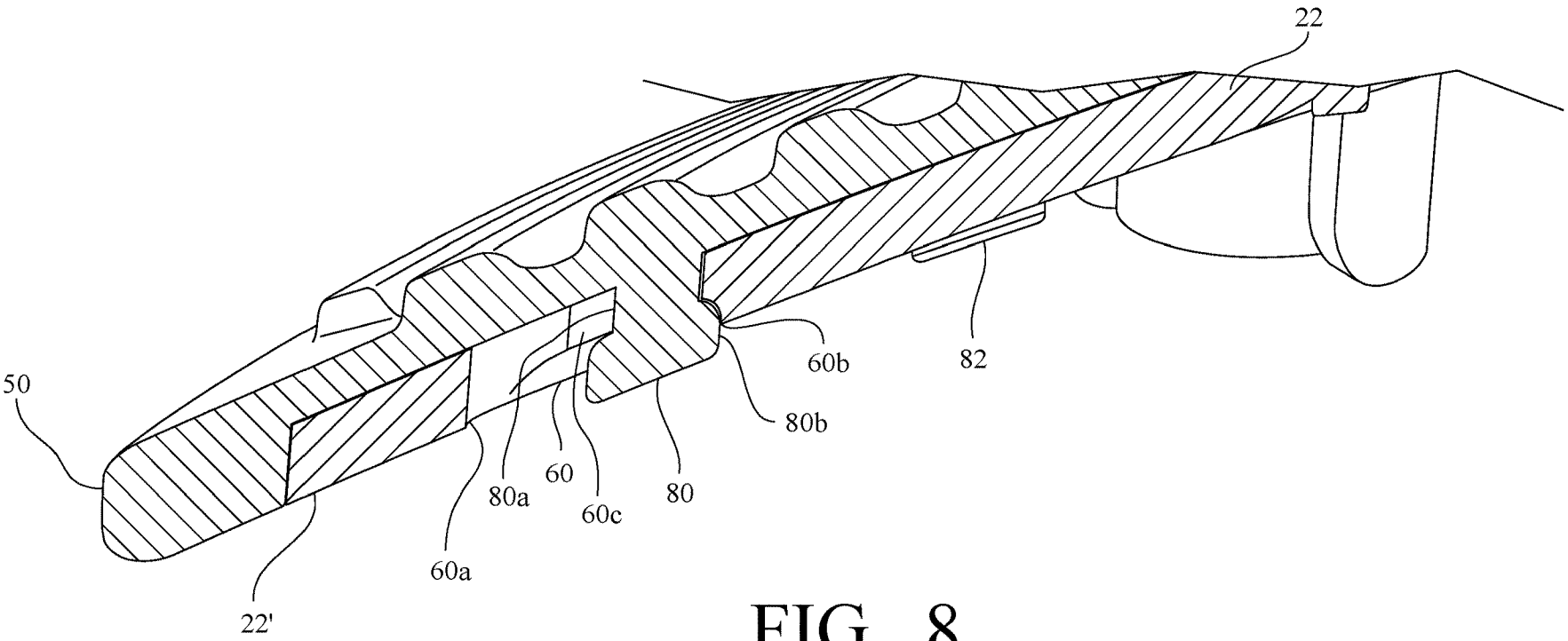
FIG. 8 is a partial sectional view of the exemplary protective helmet of FIG. 1 taken along line 8-8 of FIG. 1, with the visor secured to the shell.

FIG. 8 is a partial sectional view of the exemplary protective helmet 10 taken along line 8-8 of FIG. 1, which illustrates the engagement of one boss 80 in the corresponding opening 60 of the shell 20. As shown, in this exemplary embodiment, as the boss 80 passes from the larger diameter (or enlarged) portion 60*a* over detent 60*c* and into the smaller diameter (or reduced) portion 60*b* of the opening 60, the enlarged head 80*b* of the boss 80 engages and is effectively supported by an internal shelf defined within the opening 60.

As a further refinement, in this exemplary embodiment, and referring again to FIGS. 4 and 7, at the "dividing line" between the second end portion 50*c* and the intermediate portion 50*b*, there is a ridge 56*c* that extends from the underside of the visor 50. A similar ridge 26*c* is defined on the underside of the brim 22 of the shell 20 of the hard hat 10. These ridges 56*c*, 26*c* collectively form a slot 98, and a coin can be inserted in the slot 98 and twisted to disengage the bosses 90, 92, 94 from the openings 70, 72, 74.

Similarly, at the "dividing line" between the first end portion 50*a* and the intermediate portion 50*b*, there is an integral ridge 56*a* that extends from the underside of the visor 50. A similar ridge 26*a* is defined on the underside of the brim 22 of the shell 20 of the hard hat 10. These ridges 56*a*, 26*a* collectively form a slot, and a coin can be inserted in the slot and twisted to disengage the bosses 80, 82, 84 from the openings 60, 62, 64.

As a further refinement, in this exemplary embodiment, and referring again to FIG. 3, the rearmost bosses 84, 94 on either side of visor 50 are larger than the other bosses 80, 82, 90, 92. These bosses 84, 94 are also provided with a central hole, which could be used, for example, to insert a fastener to further secure the visor 50 to the shell 20 of the hard hat (or other protective helmet) 10.

Although a visor (or lens) 50 is described above as the accessory that is secured to a hard hat, a wide range of accessories, including, for example, clear/tinted visors, face protection shields, hydration devices, electronic communication devices, lighting apparatus, could be secured to a protective helmet using the attachment mechanism of the present invention.

Figure 9:
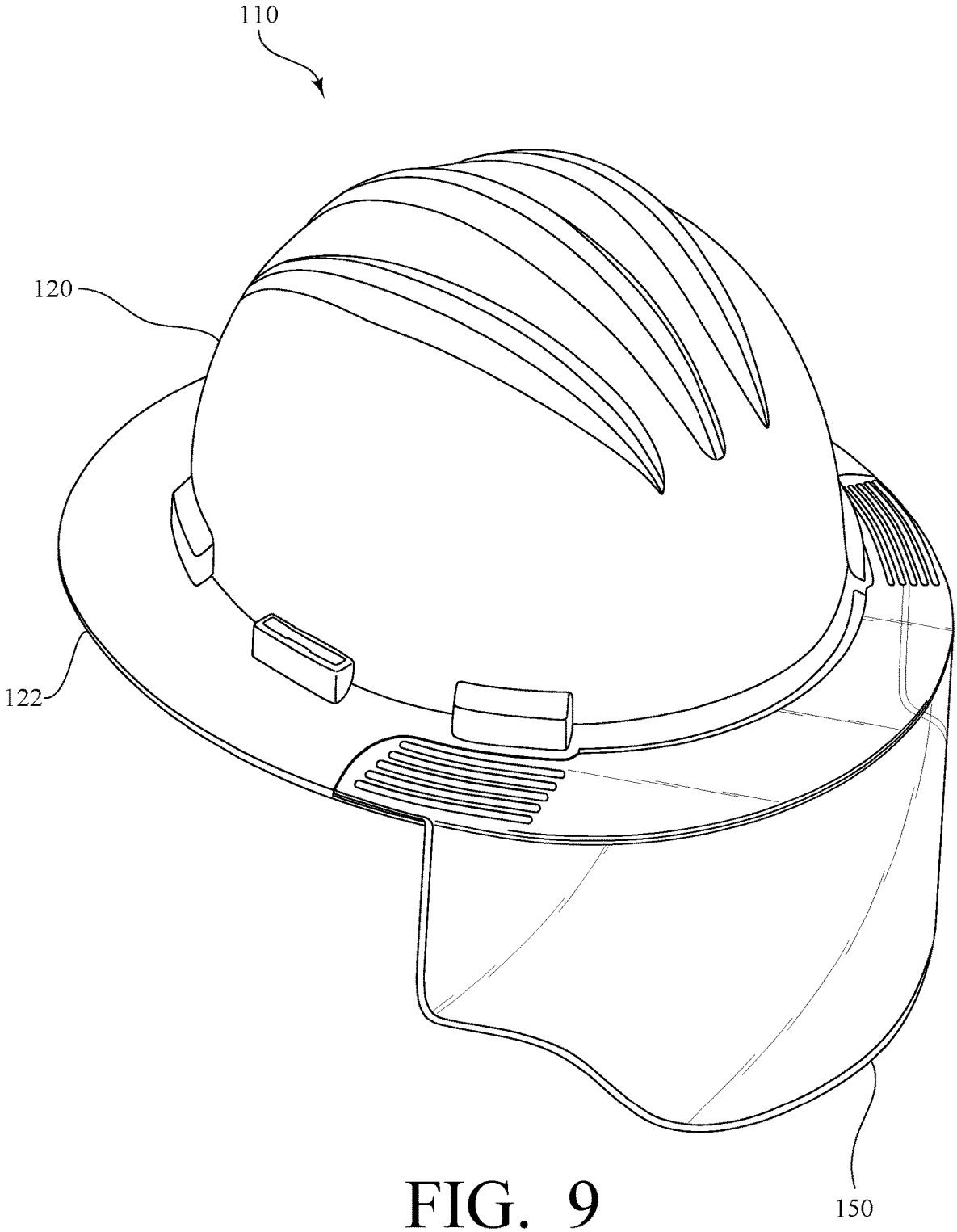
FIG. 9 is a perspective view of another exemplary protective helmet that includes an attachment mechanism made in accordance with the present invention, securing a face protection shield to the helmet.

FIG. 9 is a perspective view of an exemplary protective helmet 110 that includes an attachment mechanism made in accordance with the present invention, securing a face protection shield 150 to the helmet 110.

One of ordinary skill in the art will recognize that additional embodiments are also possible without departing from the teachings of the present invention. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A protective helmet adapted to receive and protect a wearer's head, comprising:

a shell shaped to protect the wearer's head, the shell defining a bottom opening and an internal cavity for receiving the wearer's head, and the shell further including a brim projecting outwardly near the bottom opening and substantially circumscribing the bottom opening, but with a central opening defined in the brim that extends between a first end of the brim and a second end of the brim; and an attachment mechanism for securing an accessory to the shell, in part, in the central opening defined in the brim, including one or more openings defined through the brim on a first side of the central opening, wherein each of the one or more openings includes a larger diameter portion and a smaller diameter portion, which are separated by a detent, such that each opening can receive a respective boss of the accessory, which can be selectively advanced from the larger diameter portion to the small diameter portion of the opening, one or more openings defined through the brim on an opposite side of the central opening, wherein each of the one or more openings includes a larger diameter portion and a smaller diameter portion, which are separated by a detent, such that each opening is configured to receive a respective boss of the accessory, which can be selectively advanced from the larger diameter portion to the small diameter portion of the opening, and a slot defined in and along an edge of the shell, wherein the slot is co-extensive with the central opening defined in the brim of the shell, such that the slot extends between the first end of the brim and the second end of the brim and is configured to receive a projection extending from the accessory.

2. A protective helmet adapted to receive and protect a wearer's head, comprising:

a shell shaped to protect the wearer's head, the shell defining a bottom opening and an internal cavity for receiving the wearer's head, and the shell further including a brim projecting outwardly near the bottom opening and substantially circumscribing the bottom opening, but with a central opening defined in the brim that extends between a first end of the brim and a second end of the brim;

an accessory secured to the shell, in part, in the central opening defined in the brim, and including multiple bosses extending from a surface of the accessory; and an attachment mechanism for securing the accessory to the shell, including one or more openings defined through the brim on a first side of the central opening, wherein each of the one or more openings includes a larger diameter portion and a smaller diameter portion, which are separated by a detent, such that each opening receives one of the multiple bosses extending from the surface of the accessory, which can be selectively advanced from the larger diameter portion to the small diameter portion of the opening, one or more openings defined through the brim on an opposite side of the central opening, wherein each of the one or more openings includes a larger diameter portion and a smaller diameter portion, which are separated by a detent, such that each opening receives one of the multiple bosses extending from the surface of the accessory, which can be selectively advanced from the larger diameter portion to the small diameter portion of the opening, and a slot defined in and along an edge of the shell, wherein the slot is co-extensive with the central opening defined in the brim of the shell, such that the slot extends between the first end of the brim and the second end of the brim and receives a projection extending from the accessory.

3. The protective helmet as recited in claim 2, wherein there are at least three openings defined through the brim on the first side of the central opening, and wherein there are at least three openings defined through the brim on the other side of the central opening.

4. The protective helmet as recited in claim 2, wherein the accessory is a visor.

5. The protective helmet as recited in claim 2, wherein the accessory is a face protection shield.

6. The protective helmet as recited in claim 2, wherein a first ridge extends from an underside of the accessory, and wherein a second ridge is defined on an underside of the brim of the shell of the protective helmet, such that, when the accessory is secured to the shell, the first ridge and the second ridge collectively form a slot, such that a coin can be inserted in the slot and twisted to disengage the bosses of the accessory from the one or more openings defined through the brim.

7. A protective helmet adapted to receive and protect a wearer's head, comprising:

a shell shaped to protect the wearer's head, the shell defining a bottom opening and an internal cavity for receiving the wearer's head, and the shell further including a brim projecting outwardly near the bottom opening and substantially circumscribing the bottom opening, but with a central opening defined in the brim that extends between a first end of the brim and a second end of the brim;

a headband adjacent the bottom opening of the shell;

a suspension comprised of at least two straps attached to the headband and intersecting one another within the internal cavity of the shell, wherein the headband and the suspension cooperate to separate the wearer's head from the shell by maintaining an air gap between the shell and the wearer's head; and an attachment mechanism for securing an accessory to the shell, including one or more openings defined through the brim on a first side of the central opening, wherein each of the one or more openings includes a larger diameter portion and a smaller diameter portion, which are separated by a detent, such that each opening is configured to receive a respective boss of the accessory, which can be selectively advanced from the larger diameter portion to the small diameter portion of the opening, one or more openings defined through the brim on an opposite side of the central opening, wherein each of the one or more openings includes a larger diameter portion and a smaller diameter portion, which are separated by a detent, such that each opening can receive a respective boss of the accessory, which can be selectively advanced from the larger diameter portion to the small diameter portion of the opening, and a slot defined in and along an edge of the shell, wherein the slot is co-extensive with the central opening defined in the brim of the shell, such that the slot extends between the first end of the brim and the second end of the brim and is configured to receive a projection extending from the accessory.

8. A protective helmet adapted to receive and protect a wearer's head, comprising:

a shell shaped to protect the wearer's head, the shell defining a bottom opening and an internal cavity for receiving the wearer's head, and the shell further including a brim projecting outwardly near the bottom opening and substantially circumscribing the bottom opening, but with a central opening defined in the brim that extends between a first end of the brim and a second end of the brim;

a headband adjacent the bottom opening of the shell;

a suspension comprised of at least two straps attached to the headband and intersecting one another within the internal cavity of the shell, wherein the headband and the suspension cooperate to separate the wearer's head from the shell by maintaining an air gap between the shell and the wearer's head;

an accessory secured to the shell, in part, in the central opening defined in the brim, and including multiple bosses extending from a surface of the accessory; and an attachment mechanism for securing the accessory to the shell, including one or more openings defined through the brim on a first side of the central opening, wherein each of the one or more openings includes a larger diameter portion and a smaller diameter portion, which are separated by a detent, such that each opening receives one of the multiple bosses extending from the surface of the accessory, which can be selectively advanced from the larger diameter portion to the small diameter portion of the opening, one or more openings defined through the brim on an opposite side of the central opening, wherein each of the one or more openings includes a larger diameter portion and a smaller diameter portion, which are separated by a detent, such that each opening receives one of the multiple bosses extending from the surface of the accessory, which can be selectively advanced from the larger diameter portion to the small diameter portion of the opening, and a slot defined in and along an edge of the shell, wherein the slot is co-extensive with the central opening defined in the brim of the shell, such that the slot extends between the first end of the brim and the second end of the brim and is configured to receive a projection extending from the accessory.

9. The protective helmet as recited in claim 8, wherein there are at least three openings defined through the brim on the first side of the central opening, and wherein there are at least three openings defined through the brim on the other side of the central opening.

10. The protective helmet as recited in claim 8, wherein the accessory is a visor.

11. The protective helmet as recited in claim 8, wherein the accessory is a face protection shield.

12. The protective helmet as recited in claim 8, wherein a first ridge extends from an underside of the accessory, and wherein a second ridge is defined on the underside of the brim of the shell of the protective helmet, such that, when the accessory is secured to the shell, the first ridge and the second ridge collectively form a slot, such that a coin can be inserted in the slot and twisted to disengage the bosses of the accessory from the one or more openings defined through the brim.

13. A protective helmet adapted to receive and protect a wearer's head, comprising:

a shell shaped to protect the wearer's head, the shell defining a bottom opening and an internal cavity for receiving the wearer's head, and the shell further including a brim with a central opening defined in the brim that extends between a first end of the brim and a second end of the brim;

an accessory secured to the shell, in part, in the central opening defined in the brim, and including one or more bosses extending from a surface of the accessory; and an attachment mechanism for securing the accessory to the shell, including one or more openings defined through the brim corresponding to and receiving the one or more bosses of the accessory, and a slot defined in and along an edge of the shell, with the slot corresponding with the central opening defined in the brim of the shell, such that the slot is configured to receive a projection extending from the accessory, wherein a first ridge extends from an underside of the accessory, and wherein a second ridge is defined on an underside of the brim of the shell of the protective helmet, such that, when the accessory is secured to the shell, the first ridge and the second ridge collectively form a slot, such that a coin can be inserted in the slot and twisted to disengage the one or more bosses of the accessory from the one or more openings defined through the brim.

14. The protective helmet as recited in claim 13, wherein there are at least three openings defined through the brim on a first side of the central opening, and wherein there are at least three openings defined through the brim on the other side of the central opening.

15. The protective helmet as recited in claim 13, wherein the accessory is a visor.

16. The protective helmet as recited in claim 13, wherein the accessory is a face protection shield.

17. A protective helmet adapted to receive and protect a wearer's head, comprising:

a shell shaped to protect the wearer's head, the shell defining a bottom opening and an internal cavity for receiving the wearer's head, and the shell further including a brim with a central opening defined in the brim that extends between a first end of the brim and a second end of the brim;

a headband adjacent the bottom opening of the shell;

a suspension attached to the headband, wherein the headband and the suspension cooperate to separate the wearer's head from the shell by maintaining an air gap between the shell and the wearer's head;

an accessory secured to the shell, in part, in the central opening defined in the brim, and including one or more bosses extending from a surface of the accessory; and an attachment mechanism for securing the accessory to the shell, including one or more openings defined through the brim corresponding to and receiving the one or more bosses of the accessory, and a slot defined in and along an edge of the shell, with the slot corresponding with the central opening defined in the brim of the shell, such that the slot is configured to receive a projection extending from the accessory, wherein a first ridge extends from an underside of the accessory, and wherein a second ridge is defined on an underside of the brim of the shell of the protective helmet, such that, when the accessory is secured to the shell, the first ridge and the second ridge collectively form a slot, such that a coin can be inserted in the slot and twisted to disengage the one or more bosses of the accessory from the one or more openings defined through the brim.

18. The protective helmet as recited in claim 17, wherein there are at least three openings defined through the brim on a first side of the central opening, and wherein there are at least three openings defined through the brim on the other side of the central opening.

19. The protective helmet as recited in claim 2, wherein the bosses extend from a bottom surface of the accessory.

20. The protective helmet as recited in claim 8, wherein the bosses extend from a bottom surface of the accessory.

* * * * *